United States Patent [19]

Inkyo et al.

[11] Patent Number: 4,834,301

[45] Date of Patent: May 30, 1989

[54] WET STIRRED BALL MILL

[75] Inventors: Mitsugi Inkyo; Takashi Tahara; Yasutaka Kitada, all of Hiroshima, Japan

[73] Assignee: Kotobuki Eng. & Mfg., Co., Ltd., Tokyo, Japan

[21] Appl. No.: 114,797

[22] Filed: Oct. 29, 1987

[30] Foreign Application Priority Data

Oct. 31, 1986 [JP] Japan ..... 61-261038

[51] Int. Cl.[4] ..... B02C 17/16

[52] U.S. Cl. ..... 241/33; 241/171; 241/172; 241/DIG. 30

[58] Field of Search ..... 241/171, 172, 33, 180, 241/DIG. 30

[56] References Cited

U.S. PATENT DOCUMENTS

| | | | |
|---|---|---|---|
| 2,405,633 | 8/1946 | Barker et al. | 241/171 X |
| 2,754,067 | 7/1956 | Klugh | 241/171 X |
| 3,332,628 | 7/1967 | Wadham | 241/172 X |
| 4,273,647 | 6/1981 | John | 241/171 X |

FOREIGN PATENT DOCUMENTS

| | | | |
|---|---|---|---|
| 218647 | 8/1968 | U.S.S.R. | 241/172 |

OTHER PUBLICATIONS

European Patent Application, 11-84, 0126039.

Attritor Catalog published by Mitsui Miike Engineering Corp.

*Primary Examiner*—Mark Rosenbaum

*Attorney, Agent, or Firm*—Flynn, Thiel, Boutell & Tanis

[57] ABSTRACT

A vertical wet stirred ball mill is provided according to this invention, wherein a slurry raw material fed from the top of the mill body is stirred together with a grinding medium in said mill body under pressure and the material is gradually exhausted from the bottom of said mill body as it is milled. A spring-loaded conical separation valve is fitted at an exhaust port of said body. The separation valve retracts when the pressure within the mill body is increased due to plugging, thereby the annular clearance around the separation valve is enlarged to increase the amount of exhaust, leading to elimination of the plugging.

12 Claims, 4 Drawing Sheets

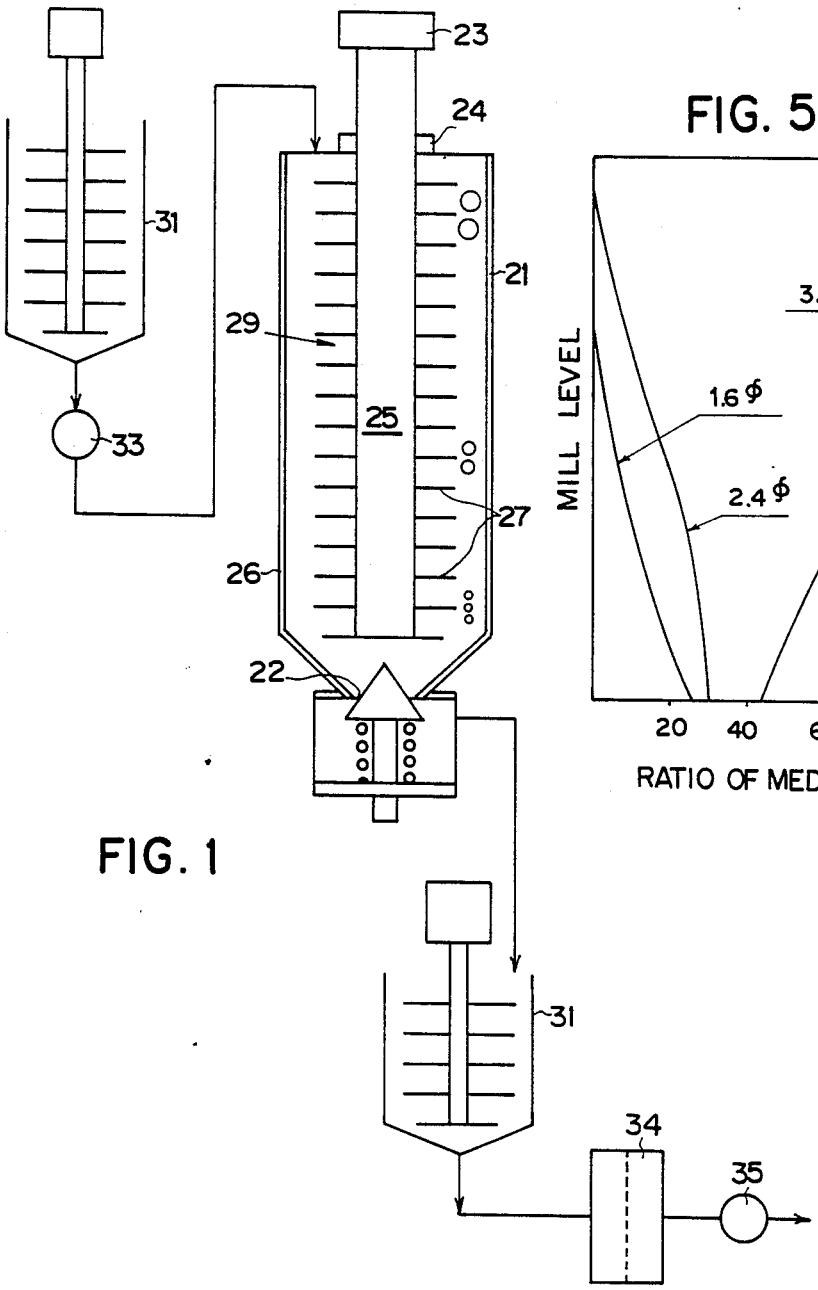
FIG. 1
FIG. 5
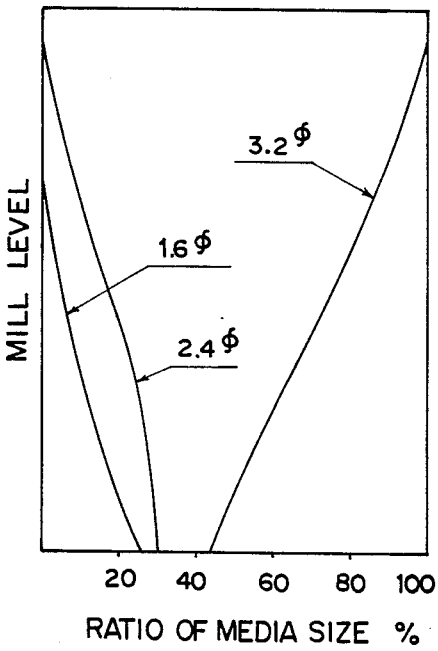

WET STIRRED BALL MILL

BACKGROUND OF THE INVENTION

The present invention relates to a wet stirred ball mill which effects grinding of a slurry raw material by stirring it together with grinding media such as steel balls, ceramic balls, glass beads, etc. into fine particles in the mill body, particularly to a wet stirred ball mill, wherein a slurry raw material is fed into the mill body of the closed type mill and is continuously exhausted as it is milled with the grinding medium under pressure.

This type of wet stirred ball mill is well known and available in many variations. The most popular one is of a type wherein a slurry raw material is fed from the bottom of the mill body, milled with a grinding medium by stirring under pressure, from which the medium is then separated, to exhaust the material by allowing it to overflow together with the waste media from the top of the mill body.

Now referring to the feeding mode, while there is Attritor mill Model S, manufactured by Union Process Inc. of Akron, Ohio, in which a slurry raw material is fed from the top of the mill body and exhausted from the bottom thereof, this type of mill actually is that of the open top type and resort is made to batchwise operation in which stirring is conducted under application of no pressure and it is not a pressurizing continuous mill.

In either type of the mills described above, the resulting slurry product to be exhausted from the mill must be separated from the medium. For such a purpose, a screen is often provided at the exhaust port through which the slurry product is allowed to be exhausted. However, plugging is liable to occur particularly in the pressurizing mill. A method of separating the medium other than using a screen is also known, in which a rotor fitted in the exhaust port is adapted to be driven for rotation to allow the slurry product to be exhausted through the annular clearance formed around the rotor and to separate, on the clearance, the grinding medium having a larger size than the aperture of the clearance. In such a construction, while plugging in the clearance may not easily be caused, the peripheral edge of the exhaust port and the rotor may easily be subject to abrasion. Thus, even the medium which is still usable may also be exhausted easily. Moreover, an inclusion of the medium in the clearance may be caused during the rotation of the rotor, and if it should happen and if the medium is made of ceramic, said medium will be broken by said inclusion.

Also, there has been proposed a device in which the exhaust port is adapted to be vibrated for preventing plugging thereof. The one disclosed in Japanese Provisional Patent Publication No. 216747/1986 may be given as an example of such type of mill, in which a conical (cione-shaped) valve is fitted at the exhaust port with sufficient clearance and designed to be vibrated to prevent plugging of the exhaust port around said valve. However, in this device the grinding medium is exhausted together with the slurry product continuously, and the medium is separated outside the mill body. Accordingly, the valve does not have a function to separate the grinding medium. It is possible to impart a function of separating the grinding medium to the valve by narrowing the clearance of the exhaust port. In such an instance, however, it is not possible to eliminate the plugging by enlarging the clearance only when plugging has occurred, since the valve vibrates irrespective of the presence or absence of plugging around the valve, to cause increase and decrease of the clearance repeatedly. Moreover, in such a mill, the gain and loss of the clearance caused by the vibration is constant, thereby plugging may not be eliminated in some cases depending on the degree of plugging. Although it is possible to overcome the problem of plugging by making the gain and loss of clearance larger, a wider clearance will be provided, when it is not desired, to increase the amount of exhaust. Accordingly, it becomes difficult to keep the liquid level constant, and also the dwell time that the slurry raw material dwells in the mill body will be reduced, making it impossible to obtain a product with a desired particle size through one pass. Moreover, the medium which is still effective will be easily be exhausted.

SUMMARY OF THE INVENTION

An object of the present invention is to prevent plugging in an exhaust port which is one of the technical subjects to be improved in a wet stirred ball mill in which a grinding medium is separated at the exhaust port.

According to the present invention, a wet stirred ball mill is provided, comprising a conical separation valve retractably fitted to the exhaust port and an operation means for advancing or retracting the separation valve by means of the pressure within the mill body, and also provided with a pressure control valve which is designed to enlarge or constrict an annular clearance formed around the separation valve with the retraction or advance of the separation valve according to the pressure within the mill body. By use of this mill, the grains of the medium (the medium usually has a size of 5 to 100 times as large as the clearance) having a size larger than the aperture of the clearance is separated on the clearance (see FIG. 8). When plugging becomes serious, the pressure within the mill body will be increased with the decrease in the amount of exhaust, with which the separation valve retracts to enlarge the clearance. Clearance will be enlarged until the plugging is eliminated, and rapidly reduced with the sudden decrease of pressure after elimination of the plugging. Each time when plugging occurs, the above operations are repeated successively (see FIG. 9). It should be noted that the aperture of the clearance when plugging occurs is not constant, and it may be great or small depending on the occasion. Also the interval between the plugging occurrence may not necessarily be constant.

As the stirring device for stirring the slurry raw material together with the grinding medium in the mill body, one having a disc fixed on the rotary shaft or having pins protruding radially therefrom is used, to conduct predominantly stirring in the direction orthogonal with the rotary shaft.

The operation means to be employed in the above mill may be exemplified by a device comprising a spring device for supporting the separation valve such as helical spring, air spring, etc., a device for detecting the pressure within the mill body, and an operation mechanism which allows the separation valve to advance or retract corresponding to the pressure detected by said device for detecting pressure within the mill body.

The separation valve may preferably be disposed at a portion closer to the peripheral wall of the mill body apart from the rotary shaft of the stirring device. If said valve is provided in alignment with the rotary shaft, stirring effect to be obtained may be smaller and the grinding medium is liable to be retained at the exhaust port. On the contrary, greater stirring effect can be obtained by providing said valve at said peripheral portion to enhance smooth flow of the raw material, thereby to allow for good passage of the liquid. In such a construction, plural separation valves can also be provided.

The separation valve may also be vibrated usually or when plugging should occur, as well as be advanced or retracted corresponding to the pressure. When the pressure within the mill body is increased to enlarge the clearance, smaller grains of the medium which have considerably been worn and which may not be exhausted through the normal aperture of clearance will be allowed to be exhausted therethrough. However, the medium is caught in the clearance to cause plugging during the advancing stroke of the valve with the reduction of pressure after elimination of the plugging, which will interfere with the advancing movement thereof. In such an instance, when the valve is vibrated, the medium caught in the clearance will be knocked out into or outside of the mill body.

In the above mill, inclusion of the medium may not easily be induced, since the separation valve is in a static state unless pressure change occurs. Also if such an inclusion should occur due to the enlargement of the clearance, the medium is retained as included therein; and, if it is made of ceramic, it may not be damaged. However, the grain size of the medium is several tens to several tens of thousands times as large as an ordinary product, and if this medium is included, the clearance will be enlarged to increase the amount of the slurry to be exhausted. As a result, not only maintenance of the liquid level will be difficult, but also the dwell time that the slurry raw material in the mill will be reduced, to induce a problem that a product having a desired particle size may not be obtained through one pass. This problem can be solved by forming either or both of the separation valve and the valve seat to which the separation valve is fitted of a soft material. When medium inclusion should occur, part of the medium will be embedded in either or both of the valve and the valve seat, thereby a clearance narrower than the diameter of the medium will be provided (see FIG. 7). The valve seat and the valve can be formed entirely or partly at strategic portions, for example, of Teflon or urethane rubber.

In order to eliminate the inclusion of medium, it is also effective to form the opening edge of the valve seat into a knife edge shape. The smaller is the contact area of said edge with the medium, the less will be the possibility of catching the medium in the clearance. If the valve seat having a knife edge shaped opening edge has resilience, the inclusion of medium will be eliminated more effectively. Because the knife edge shape is provided the inclusion of medium should happen, the edge springs up and down to knock off the media included in the clearance as shown in FIG. 6.

While the raw material may be fed from the bottom of the mill body and exhausted from the top thereof as practiced in many prior art mills, preferably it is fed from the top and exhausted from the bottom. In this regard, the present inventors have made various experiments with vertical pressurizing continuous mill in which a slurry raw material is fed from the top of the mill body and examined the state of medium distribution within the mill body. They found, as a result, that among the medium, grains of relatively large size gather in the upper part of the mill body and the grain size gradually becomes smaller toward the bottom as shown in FIG. 5. They came to know from these findings that the raw material moves downward as it is milled and effective grinding can be achieved since it is successively milled with the grains with smaller sizes toward the bottom; that stable operation of the mill can be obtained by virtue of small variation in grain size distribution in the mill body and thereby of small variation in the grinding property of the resulting product, since the grains of the medium move toward the lower part of the mill body as they are worn gradually ti be exhausted as the waste medium continuously, while new medium is supplied from the top; that the bulk density of the medium increases and also does the pressure between the grains of the medium by means of the weight of the medium itself, the dynamic energy of the slurry raw material moving downward and pressure, whereby the phenomenon of so-called short pass, wherein the raw material is fed to the mill is immediately exhausted without being stirred sufficiently therein, can be eliminated by virtue of the improved bluk density of the medium. Accordingly, far more effective grinding can be achieved.

The following Table shows the conditions and the results of comparative experiments conducted with respect to the cases wherein the slurry raw material was fed from the bottom of the mill body and the cases wherein said material was fed from the top of the mill body.

TABLE

| Raw material | Mode of feeding | Amount of medium (l) | Concentration of raw material (%) | Amount of slurry to be fed (g/min.) | Power (KW) | revolution (r.p.m.) | Particle size of product (μ) max. | Particle size of product (μ) mean |
|---|---|---|---|---|---|---|---|---|
| No. 1 | bottom | 4 | 75 | 340 | 1.5 | 500 | 15 | 1.5 |
| No. 1 | top | 4 | 75 | 340 | 1.5 | 450 | 6 | 1.4 |
| No. 2 | top | 4 | 75 | 380 | 1.5 | 450 | 20 | 1.9 |
| No. 2 | bottom | 4 | 75 | 380 | 1.5 | 500 | 40 | 2.0 |

The raw material used in each run in the above Table was calcium carbonate ($CaCo_3$), in which the raw material No. 1 had an initial maximum particle size of 35μ and an initial mean particle size of 2.3μ; the raw material No. 2 had an initial maximum particle size of 100μ and an initial mean particle size of 13μ; and the grinding medium had a grain size of 1 mm. In each run, the revolution (rpm) was set such that the power used by the mill was 1.5 KW. As can be seen from the Table, it was necessary to set the revolution (rpm) in the top feeding mode at a lower value than in the bottom feeding mode. This demonstrates that in the top feeding mode, the bulk density of the medium becomes higher and that short pass of the slurry through the mill can be reduced. As a result, a sharp particle size distribution line can be obtained for the resulting product. Namely, it can be deduced that particles come to have rather uniform particle size and variations in the particle sizes can be reduced.

Therefore, another object of the present invention is to enhance smooth flow of the raw material, thereby to allow for good passage of the liquid by disposing a separation valve at a portion closer to the peripheral wall of the mill body apart from the rotary shaft of the stirring device.

Another object of the present invention is to prevent inclusion of medium in the clearance which leads to plugging by vibrating the separation valve usually or as necessary as when well as said valve is advanced or retracted corresponding to the pressure within the mill body, even when smaller grains of the medium which may not be exhausted through the normal size of clearance should be included therein.

Still another object of the present invention is to form either or both of the separation valve and the valve seat to which said valve is fitted of a soft material to reduce enlargement of the clearanceeven when smaller grains of the medium should be included therein.

Another object of the present invention is to form the opening edge of the valve seat into a knife edge shape to reduce the possibility of catching of the medium in the clearance; and further to impart resilience to the edge of the valve seat to knock out the grains of the medium when they are included.

Another object of the present invention is to eliminate short pass of slurry raw material to achieve effective grinding thereof by feeding it from the top of a vertical mill and exhausting it from the bottom.

Other objects and advantages of the present invention will become apparent from the following description on the embodiments given with reference to the drawings.

In the drawings,

FIG. 1 shows a flow sheet;

FIG. 5 is a graph showing distribution of the medium in the mill body;

DETAILED DESCRIPTION OF THE INVENTION

Figure 2:
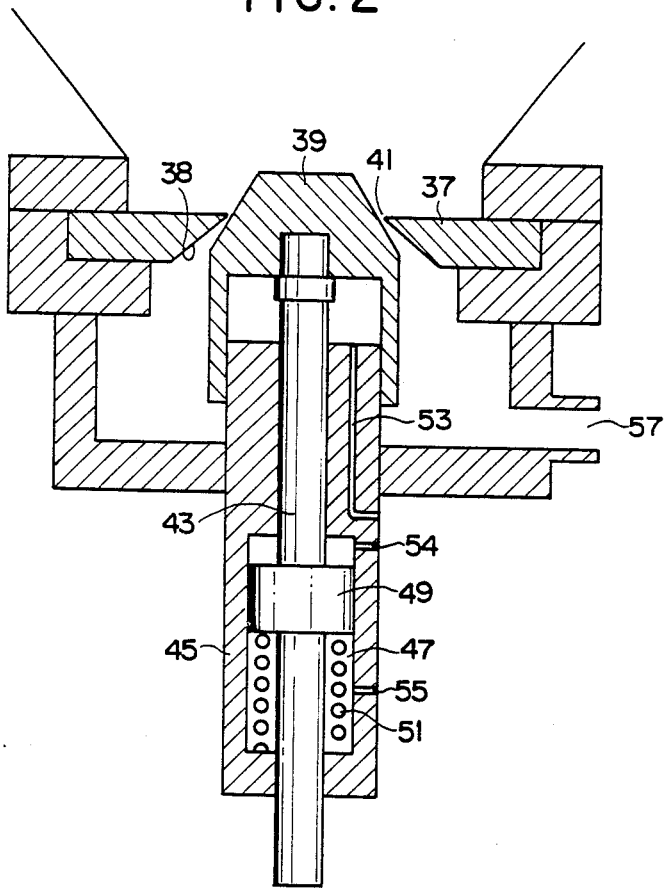
FIG. 2 shows a cross-sectional view of the exhaust port in the flow sheet as illustrated in FIG. 1.

The vertical mill body 21 comprises a cylindrical pressurized vessel having a constricted lower portion and a discharge port 22 provided at the bottom; said mill body 21 being designed to be cooled with cold water to be passed through the jacket 26 provided on the external surface of the mill body 21. A stirring device 29, comprising a vertical shaft 25 sealed by a shaft seal 24 and driven by a motor 23 for rotation and plural pins protruding radially and at regular intervals along the longitudinal direction of the vertical shaft 25, is provided at the center of the mill body 21.

A slurry raw material, which is fed from the feedstock tank 31 to the top of the mill body 21 by means of a pump 33, is stirred by the stirring device 29 under pressure in admixture with the grinding medium which has been placed in the mill body 21, and gradually moves downwardly as it is milled to fine particle size and is exhausted together with the waste grinding medium through the layer of the medium on the exhaust port 22. The resulting slurry product exhausted is passed through a screen 34 via product tank 31, from which the waste medium is then removed, and forwarded to a storage tank (not shown) by a pump 35.

Referring to FIG. 2, the exhaust port is formed in a valve seat 37, which comprises a circular opening 38 having a tapered edge such that the opening is larger toward the lower surface of the valve seat 37 as shown in FIG. 2. A separation valve 39 having a frusto-conical top is fitted to the circular opening 38 to form an annular clearance 41 with the valve seat 37 therebetween.

The separation valve 39 is fixed on the upper end of the shaft 43, and the shaft 43 is slidably inserted to the shaft center of the standard 45. Also, the separation valve 39 is fitted with the standard 45 on the upper end. The standard 45 has a cylindrical lower portion, and a plunger 49 fixed to the shaft 43 is fitted to the cavity 47. A helical spring 51 is disposed in the space defined between the plunger 49 and the bottom of the cavity 47. The shaft 43 and the separation valve 39 connected to said shaft 43 are pushed up by the function of the helical spring 51 and pushed down by the pressure within the mill body against the urging of the helical spring 51. Thus, the clearance 41 formed between the valve seat 37 and the valve 39 varies. The numerals 53, 54 and 55 each show an air vent. The air vents 54 and 55 formed in the upper and lower portions of the plunger 49 are adapted to be capable of introducing compressed air such that the separation valve 39 may be retractable as the advancing or retracting movement of the plunger 49 when compressed air is introduced into one of these air vents.

OPERATION

The mill device of the present invention has a construction as described heretofore, in which the clearance between the valve and the valve seat is kept at a predetermined aperture when the pressure within the mill is maintained at a constant level and also when the mill is operated under normal condition, to allow separation of the medium from the slurry product to be left on said clearance and exhaust of said product in fixed amounts from the clearance 41 through the discharge port 57 together with the waste grinding medium to be forwarded to the product tank 31.

However, when plugging begings to occur in the clearance, the separation valve 39 descends against the resisting function of the helical spring 51 until it is in equilibrium with the resistance of said spring 51 with the increase of the pressure of the slurry within the mill. Accordingly, the clearance will be enlarged and thus the amount of slurry to be exhausted will increase suddenly to eliminate the plugging. When the plugging is eliminated and the pressure within the mill body is reduced, the separation valve 39 ascends under the urging of the spring 51. Thus, although the rate of exhausting the material may temporarily increase, it will return to a normal rate after elimination of the plugging.

Figure 3:
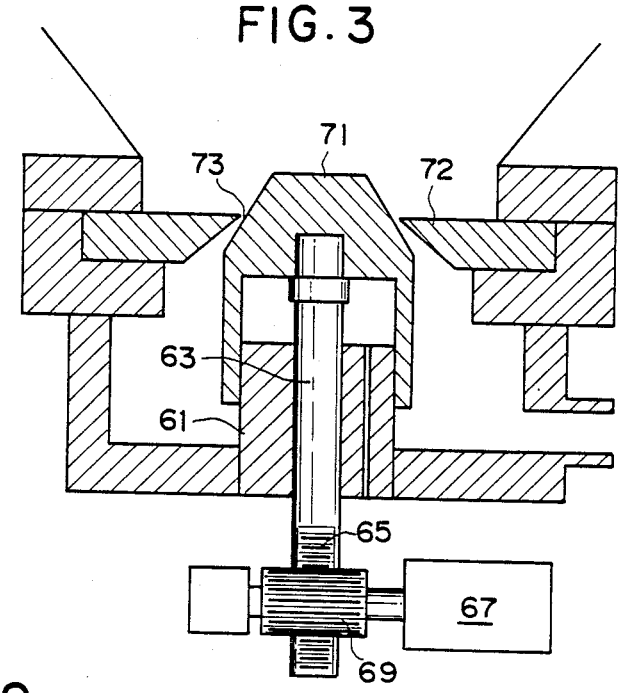
FIG. 3 is another embodiment of the exhaust port of the mill showing in cross-section.
Figure 9:
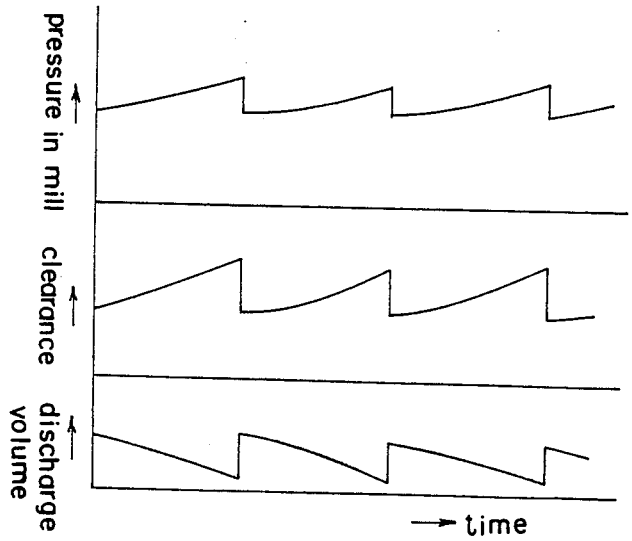
FIG. 9 is a diagram showing the relationship between the pressure within the mill body, clearance aperture and the amount of the raw material to be exhausted.

FIG. 3 shows another embodiment of the device for operating the separation valve, wherein a rack 65 is formed in the lower part of a shaft 63 which is slidably fitted to the bearing 61 and is engaged with a pinion 69 driven by a servo motor 67 for rotation. The servo motor 67 is controlled by a pressure detection mechanism for detecting the pressure within the mill body and is adapted to be rotatable normally and reversely with a required number of revolutions corresponding to the pressure change within the mill body. When the servo motor 67 is rotated with a required number of revolutions normally or reversely according to the pressure change within the mill body, a separation valve 71 is adopted to ascend to change the clearance 73 between said valve 71 and a valve seat 72.

Figure 4:
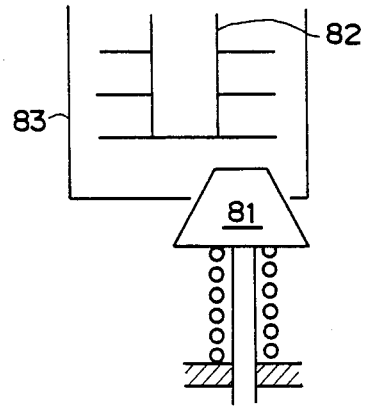
FIG. 4 shows another embodiment of the exhaust port schematically which is disposed offset from the center of the mill.

FIG. 4 shows an embodiment wherein a separation valve 81 is laterally offset from the shaft center of a stirring device 82 and is disposed at a location closer to the peripheral wall of a mill body 83. Since a larger stirring action by the stirring device 82 can be obtained along the peripheral portion rather than in the shaft center position, the separation valve is disposed at a portion closer to the peripheral wall of the mill body to enhance smooth flow of the raw material, thereby to allow for good passage of the liquid.

Figure 6:
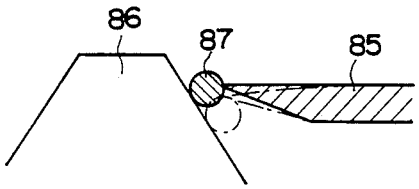
FIG. 6 is an operation view of the resilient edge of the valve seat.
Figure 8:
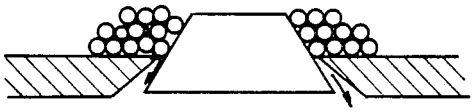
FIG. 8 shows a state when the medium is separated on the clearance for exhausting the slurry material.

In the above embodiments, while the separation valve 39, 71 or 81 descends, caused by the pressure increase of the slurry in the mill body as described above, thereby the clearance is enlarged to increase the amount of material exhausted temporarily, relatively larger grains of the grinding medium which would not normally be exhausted through said clearance may be allowed to be exhausted together with the slurry product with the increase of the clearance 41 or 73. Relatively larger grains of the grinding medium, which were going to be discharged because the clearance had been enlarged, will, when the valve is ascending due to the pressure reduction caused by the temporary increase of the exhaust amount, be included inbetween the valve seat and the separation valve to cause plugging of the clearance. Thus, the separation valve may sometimes fail to return to the normal state. Such inclusion of medium may be moderated to some extent by forming the opening edge of the valve seat into a knife edge shape to provide a condition in which the medium will not easily be caught in the clearance, i.e. to make it easy for the medium to escape therefrom. However, in addition to the above, for example, a vibrator can be connected to the shaft 43 or 63 to vibrate said valve usually or when the medium inclusion occurs; or, as shown in FIG. 6, resilience can be imparted to the opening edge of the valve seat 85 to eliminate the medium inclusion. More specifically, the medium included can thus be knocked out into or outside of the mill body.

Figure 7:
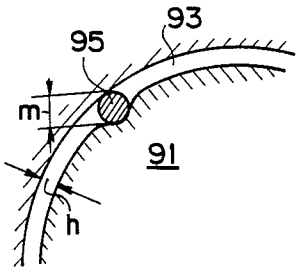
FIG. 7 is an enlarged partial cross-sectional view of a state where a grain of the medium is included in the clearance of the mill whose separation valve has been formed of a soft material.

The inclusion of the grinding medium in the clearance further causes the following problems in addition to the problem of difficulty in resetting the separation valve. To describe in detail, since the particle size of the grinding medium is in many cases several tens to several tens of thousands times larger than that of the slurry product, the clearance will be enlarged if the medium is included therein to increase the amount of slurry to be exhausted. Therefore, not only maintenance of the liquid level will be difficult, but also the time that the slurry raw material dwells within the mill body will be shorter, resulting in the failure of obtaining a product having a desired particle size through one pass. FIG. 7 shows an embodiment wherein the separation valve 91 is formed of a urethane rubber in order to cope with the above problem; in which if the medium 95 is included in the clearance 93, it is designed that the medium may be partly embedded in the separation valve 91 for providing a clearance h narrower than the grain size m of the grinding medium 95.

It is further understood by those skilled in the art that the foregoing description is preferred embodiments of the disclosed device and that various changes and modifications may be made in the invention without departing from the spirit and the scope thereof.

We claim:

1. A wet, stirred, ball mill, comprising:

a closed mill body having an inlet for continuously feeding a slurry of raw material into said mill body and an exhaust port for continuously discharging ball-milled material from said mill body, said exhaust port having a valve seat;

a rotatable stirrer in said mill body and adapted for continuously stirring said slurry, under pressure, in admixture with a particulate grinding medium;

a separation valve movably disposed in said exhaust port and having a valve surface opposed to said valve seat, operation means coupled to said valve and continuously responsive to the pressure in said mill body so that the spacing between said valve seat and said valve surface depends on the pressure inside the mill body, said operation means positioning said separation valve in a first position in said exhaust port in which there is a minimum clearance between said valve surface and said valve seat when the pressure in said mill body is at a normal first level so that the ball-milled material is discharged from said mill body and the particles of said grinding medium of larger size than said minimum clearance are separated from the ball-milled material and are retained in said mill body, said operation means unidirectionally enlarging the clearance between said valve surface and said valve seat in response to the pressure in said mill body being higher than said normal first level, so that the width of said clearance depends on the pressure in said mill body and is enlarged until plugging of said clearance is eliminated, and unidirectionally decreasing said clearance to return said valve to said first position in response to the decrease of pressure in said mill body that occurs when the plugging is eliminated.

2. The mill according to claim 1, wherein said operation means comprises a spring device for supporting said separation valve.

3. The mill according to claim 1, wherein said operation means comprises a pressure detection device for detecting the pressure within said mill body and an operation mechanism for advancing or retracting said separation valve corresponding to the pressure detected by said detection device.

4. The mill according to claim 1, wherein said separation valve is laterally offset from the axis of rotation of said stirrer and is disposed at a position closer to the peripheral wall of said mill body.

5. The mill according to claim 1, wherein either or both of said valve seat and said separation valve is made of an elastomeric material.

6. The mill according to claim 1, wherein the opening edge of said exhaust port has the shape of a knife edge.

7. The mill according to claim 6, wherein the opening edge of said exhaust port is resilient.

8. The mill according to claim 1, wherein said inlet is at the top of said mill body and said exhaust port is at the bottom thereof.

9. A wet, stirred, ball mill, comprising:

a closed mill body having an inlet for continuously feeding a slurry of raw material into said mill body and an exhaust port for continuously discharging ball-milled material from said mill body, said exhaust port having a valve seat;

a rotatable stirrer in said mill body and adapted for continuously stirring said slurry, under pressure, in admixture with a particulate grinding medium;

a separation valve movably disposed in said exhaust port and having a valve surface opposed to said valve seat, operation means coupled to said valve and continuously responsive to the pressure in said mill body so that the spacing between said valve seat and said valve surface depends on the pressure inside the mill body, said operation means including spring means for unidirectionally urging said separation valve in a first direction into a first position in said exhaust port in which there is a minimum clearance between said valve surface and said valve seat when the pressure in said mill body is at a normal first level so that the ball-milled material is discharged from said mill body and the particles of said grinding medium of larger size than said minimum clearance are separated from the ball-milled material and are retained in said mill body, said operation means also including a movable surface located in said mill body so as to be acted on by the pressure in said mill body and coupled to said spring for compressing said spring and at the same time unidirectionally enlarging the clearance between said valve surface and said valve seat in response to the pressure in said mill body being higher than said normal first level, so that the width of said clearance depends on the pressure in said mill body and is enlarged until plugging of said clearance is eliminated, and then releasing said spring and unidirectionally decreasing said clearance to return said separation valve to said first position in response to the decrease of pressure in said mill body that occurs when the plugging is eliminated.

10. A ball mill as claimed in claim 9 in which said separation valve is frusto-conical and has a flat surface at the narrow end thereof which flat surface is received in said mill body, a rod extending from said separation valve in a direction away from said mill body and said flat surface, and said spring means is a coil spring coupled to said rod for urging said rod toward said mill body and thereby urging said separation valve into said first position.

11. A wet, stirred, ball mill, comprising:

a closed mill body having an inlet for continuously feeding a slurry of raw material into said mill body and an exhaust port for continuously discharging ball-milled material from said mill body, said exhaust port having a valve seat;

a rotatable stirrer in said mill body and adapted for continuously stirring said slurry, under pressure, in admixture with a particulate grinding medium;

a movable separation valve disposed in said exhaust port and having a valve surface opposed to said valve seat, operation means comprising electric motor means coupled to said separation valve and continuously responsive to the pressure in said mill body, said operation means positioning said separation valve in a first position in said exhaust port in which there is a minimum clearance between said valve surface and said valve seat when the pressure in said mill body is at a normal first level so that the ball-milled material is discharged from said mill body and the particles of said grinding medium of larger size than said minimum clearance are separated from the ball-milled material and are retained in said mill body, said operations means including means for operating said motor for moving said separation valve unidirectionally away from said first position so as to enlarge the clearance between said valve surface and said valve seat when the pressure in said mill body is higher than said normal first level, so that the width of said clearance is enlarged until plugging of said clearance is eliminated, and unidirectionally decreasing said clearance to return said separation valve to said first position in response to the decrease of pressure in said mill body that occurs when the plugging is eliminated.

12. A ball mill as claimed in claim 11 in which said separation valve is frusto-conical and has a flat surface at one end thereof which flat surface is received in said mill body, a rod extending from said separation valve in a direction away from said mill body and said flat surface, said rod having a gear rack formed thereon, a rotatable drive gear drivingly engaged with said rack, said motor being drivingly connected to said drive gear for rotating said drive gear.

* * * * *